United States Patent [19]

Bester

[11] Patent Number: 4,478,234

[45] Date of Patent: Oct. 23, 1984

[54] COLLAPSIBLE FRAME FOR PORTABLE SHELTERS

[76] Inventor: Anthony V. Bester, 1825 3rd Ave. South, Minneapolis, Minn. 55404

[21] Appl. No.: 373,657

[22] Filed: Apr. 30, 1982

[51] Int. Cl.[3] ..... A45F 1/04

[52] U.S. Cl. ..... 135/98; 135/93; 135/901

[58] Field of Search ..... 135/93, 98, 107, 108, 135/120, 901, DIG. 8, 117, 99, 102, 119, DIG. 1, 114, 115; 273/80 D, 63

[56] References Cited

U.S. PATENT DOCUMENTS

| | | | |
|---|---|---|---|
| 209,772 | 11/1878 | Nisbet et al. | 135/98 |
| 2,147,872 | 2/1939 | Wittcoff | 135/93 |
| 2,575,572 | 11/1951 | Wickstrum | 135/120 |
| 2,864,389 | 12/1958 | Smith et al. | 135/98 |
| 3,502,326 | 3/1970 | Schaeffer | 273/80 D |

*Primary Examiner*—Richard J. Apley
*Assistant Examiner*—S. R. Crow

[57] ABSTRACT

A collapsible supporting frame structure for portable shelters which includes a plurality of radially extending pivoted legs having their upper ends pivotally connected with an upper supporting ring and intermediate portions having a pivotal link connection with a lower supporting structure and a hollow slide member with its lower end fixed to the lower supporting structure and slidably mounted through said upper ring, whereby the raising of the hollow slide member through the upper ring causes radial expansion of the supporting leg structure into outwardly spaced, ground-engaging position and including the extension of said hollow member upwardly through said ring to provide a smoke stack for the area confined under the supporting leg structure.

5 Claims, 11 Drawing Figures

COLLAPSIBLE FRAME FOR PORTABLE SHELTERS

BACKGROUND OF THE INVENTION

In the past, a number of different collapsible frames have been provided for collapsible shelters, however, none of these includes a hollow smoke stack unit which is readily collapsible within the confines of the collapsed supporting legs while providing a guide for the operating linkage which controls the collapsing and expansion of the leg structure. Such a prior art structure is shown in my previously issued U.S. Pat. No. 3,008,477, granted November 14, 1961.

SUMMARY OF THE INVENTION

This invention constitutes a plurality of spider-like collapsible legs pivoted at their upper ends to an upper connecting ring and extending outwardly and downwardly therefrom, each of said legs having an operating link connected with an intermediate portion thereof and extending inwardly to a lower connecting ring which has a hollow upstanding stove pipe element fixed at its lower end to said lower ring and slidably extending upwardly through the upper ring so that when the legs are in expanded position, the lower ring and stove pipe will be in their uppermost position with the stove pipe extending a substantial distance above the upper ring.

DETAILED DESCRIPTION

Figures 1, 2, 3, 4A, 4B, 4C, 4D, 5, 6, 7, 8:
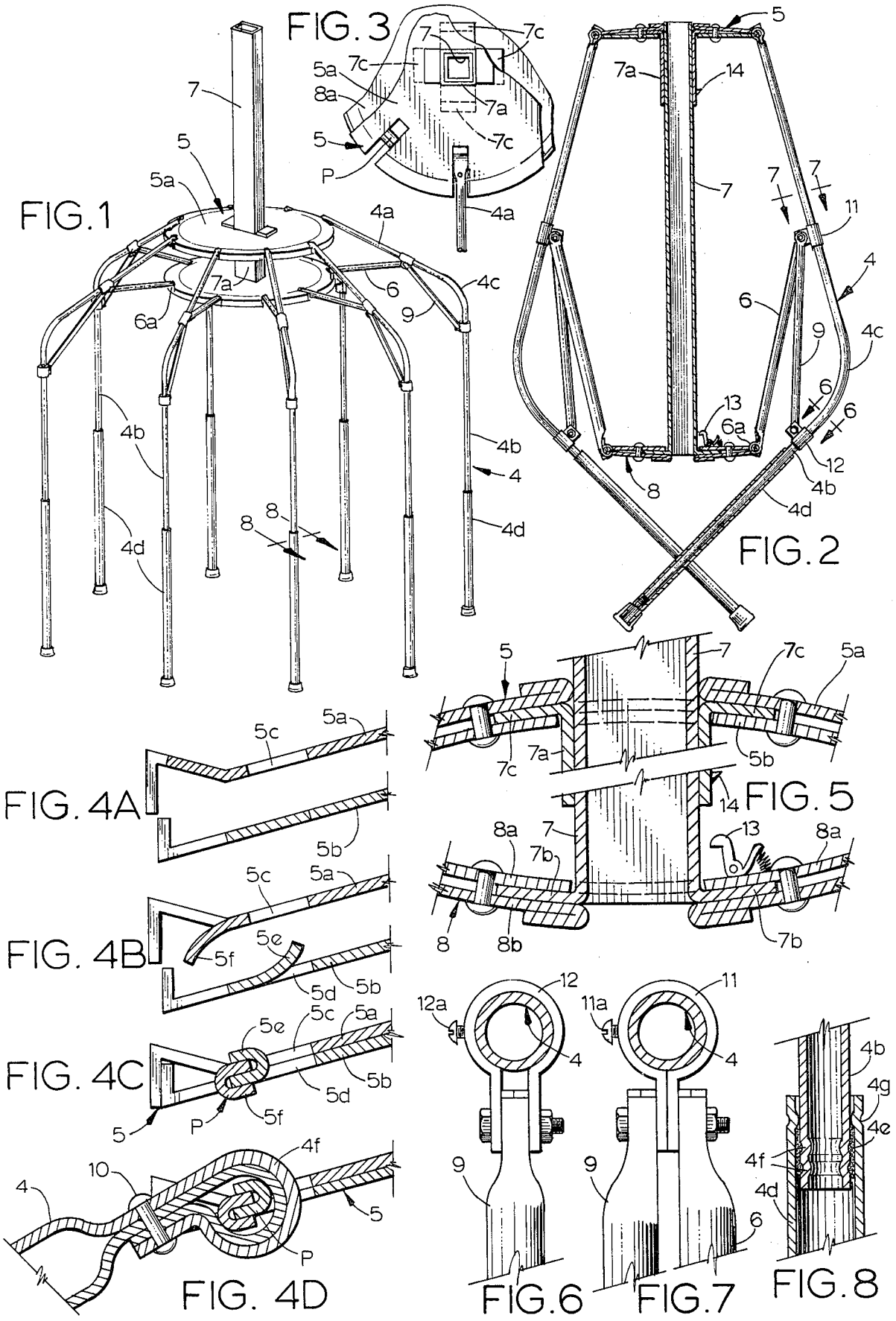
FIG. 1 is a perspective view of the frame structure in expanded position.
FIG. 2 is a central, vertical sectional view taken substantially along the line 2—2 of FIG. 3.
FIG. 3 is a fragmentary top plan view of the upper mounting ring.
FIGS. 4A through 4D are vertical sectional views showing the construction of the cross pivot elements.
FIG. 5 is a central, vertical sectional view showing the connection of the chimney and guiding sleeve therefor.
FIGS. 6 and 7 show the connection between the legs and the respective connector sleeves.
FIG. 8 is a fragmentary sectional view showing the friction joint between the telescoping lower leg extensions and lower leg portions.

As shown in the drawings, the collapsible frame structure includes the pivoting legs 4, each of which include upper segments 4*a*, bend portions 4*c*, and a downwardly extending lower segment 4*b*. The lower segment 4*b* of each leg is telescopically connected to a leg extension element 4*d*.

The legs 4 are pivotally connected at their upper ends to an upper mounting ring assembly 5 which has a hollow, polygonal upstanding member such as the rectangular chimney 7. Each leg 4 has an intermediate portion pivoted to the outer end of an intermediate control link 6 whose other end is pivotally connected at 6*a* to a lower connecting ring 8.

A rectangular sleeve element 7*a* is fixed to the upper ring 5 and slidably receives the chimney 7 therethrough in non-rotatable relation thereto.

The central chimney 7 extends upwardly from the lower mounting ring assembly 8, through and beyond the sleeve member 7*a*. The chimney 7 retracts downwardly when the structure is collapsed, and extends upwardly when it is erected.

Both the upper mounting ring assembly 5 and the lower mounting ring assembly 8 have a generally similar construction. Both are constructed of a pair of mating discs respectively designated by the reference characters 5*a* and 5*b*, and 8*a* and 8*b*. FIGS. 4A through 4D show a typical pivot member between the upper ends of the legs 4 and the upper mounting ring assembly 5. The upper disc 5*a* has an opening 5*c* formed therein and an opening 5*d* opposite to opening 5*c* is formed in the lower disc 5*b*. The outer ends of the two discs 5*a* and 5*b* are cut away as indicated in FIGS. 4B and 4C to form a leg-receiving opening through the outer periphery of the ring 5. In the form shown, the material from the opening 5*d* is designated by the numeral 5*e* and the material from the cut away portion of the upper disc 5*a* is designated by the numberal 5*f*. As illustrated, the two cut away portions 5*e* and 5*f* are crimped together as shown in FIG. 4C to form a cross pivot member designated as an entirety by the letter P shown in FIGS. 4C and 4D. The upper ends of the legs 4 are flattened and bent around the cross pivots P as indicated at 4*f* in FIG. 4D, and a suitable connection is made such as by the rivet 10 to positively anchor the outer leg portions together to complete the pivot joint. The lower ring assembly 8 is similarly constructed to the upper ring assembly 5, and the cross pivots P for the links 6 are of similar construction to the cross pivots P previously described in connection with the upper ring assembly 5. The lower end of the chimney 7 has connecting flanges 7*b* formed thereon which are securely clamped together between the disc elements 8*a* and 8*b* as shown in FIG. 5. The guiding sleeve 7*a* has similar connecting flanges 7*c* formed thereon and securely clamped between the upper disc 5*a* and the lower disc 5*b* of the upper ring assembly 5.

Each of the legs 4 is provided with a rigid strut element 9 which is secured at its ends to clamping sleeves 11 and 12, each of which is set screwed to the portion of the leg 4 surrounded thereby as best shown in FIGS. 6 and 7. Suitable set screws 11*a* and 12*a* respectively, securely hold the clamping sleeves 11 and 12 to the surrounded portions of each leg 4.

The leg extension elements 4*d* slide on the lower leg portions 4*b* and friction between the two leg elements 4*b* and 4*d* is provided by nylon twine 4*e* wound around the inner telescoping portion of leg elements 4*b*.

A pair of spaced, crimped grooves 4*f* in the inner leg element 4*b* lock the twine against longitudinal movement to maintain the adjusted position of the leg extension 4*d* on the leg element 4*b*. Another crimp 4*g* is formed in the upper portion of leg extension 4*d* to abut the nylon winding 4*e* and prevent inadvertent removal of the extension element 4*d* from the lower leg portion 4*b*.

A suitable latch such as the spring rest hook element 13 and detent 14 are provided to hold the lower mounting ring 8 in engagement with the lower end of the guiding sleeve 7*a* when the unit is in assembled position.

It will be seen that I have provided an extremely rigid collapsing frame structure around which can be mounted a flexible covering such as a canvas to provide a water-proof shelter or mosquito netting to surround a small swimming pool in the summer or the like.

What is claimed is:

1. A collapsible frame for a portable shelter comprising, an upper supporting ring, a plurality of bent elements respectively defining planes disposed generally radially of said upper ring and having their upper ends pivotally connected in circumferentially spaced relation around said upper supporting ring, a lower supporting ring disposed below said upper ring, a plurality of control links respectively lying generally in the plans defined by said legs and extending between the lower ring and intermediate portions of the leg elements and pivotally connecting said ring and said intermediate leg portions, an elongated upstanding member having its lower end fixed to the lower ring and slidably extending upwardly through the upper ring to provide a stabilizing slide between the upper and lower rings during erection and collapsing of the frame leg elements, stop means limiting the upper movement of said upstanding member in erected position, and wherein both of said support rings are formed from a pair of opposed disc elements having cross pivot elements formed from partially cut away material of said discs to provide the pivot connection with the upper ends of the legs and the inner ends of the control links, respectively.

2. The structure set forth in claim 1 and the upper ends of said legs being flat in cross section and doubled back upon themselves around the cross pivot elements respectively formed by the cut-away portions of said discs to provide the pivot connection between the legs and the control links.

3. The structure set forth in claim 1 wherein the lower end of said upstanding member is flared outwardly to provide connecting flanges and the inner portion of the pair of disc elements forming the lower supporting ring being tightly clamped to said flange elements to provide a rigid connection between the upstanding member and the lower ring.

4. The structure set forth in claim 1 wherein said elongated upstanding member is hollow to provide a chimney for an imperforate collapsible shelter supported by said frame in order to produce a safe, cold weather portable shelter unit, wherein said hollow upstanding member is polygonal in shape and slidably extends through a similar shaped opening in said upper ring to prevent relative rotation between said ring and said upstanding member, and a hollow sleeve member fixed to said upper ring and extending downwardly therefrom in close-fitting relationship to the elongated polygonal chimney member to provide a stable sliding relationship between the two rings.

5. The structure set forth in claim 4 wherein the hollow sleeve member is provided with outwardly flared connecting flanges fixed to said upper ring member by being clamped between the inner portions of said opposed disc elements.

* * * * *